US007851389B2

(12) United States Patent
Köckritz

(10) Patent No.: US 7,851,389 B2
(45) Date of Patent: Dec. 14, 2010

(54) PAPER MACHINE BELT

(75) Inventor: Uwe Köckritz, Heidenheim (DE)

(73) Assignee: Voith Patent GmbH, Heidenheim (DE)

( * ) Notice: Subject to any disclaimer, the term of this patent is extended or adjusted under 35 U.S.C. 154(b) by 0 days.

(21) Appl. No.: 12/468,098

(22) Filed: May 19, 2009

(65) Prior Publication Data

US 2009/0286438 A1 Nov. 19, 2009

(30) Foreign Application Priority Data

May 19, 2008 (DE) ..... 10 2008 001 854

(51) Int. Cl.
*B32B 5/18* (2006.01)

(52) U.S. Cl. ..... 442/221; 428/304.4

(58) Field of Classification Search ..... 428/304.4, 428/311.11, 311.51, 315.9, 314.2; 442/221, 442/323

See application file for complete search history.

(56) References Cited

U.S. PATENT DOCUMENTS

| | | | | |
|---|---|---|---|---|
| 3,059,312 | A * | 10/1962 | Jamieson | 442/224 |
| 3,421,230 | A | 1/1969 | Ward | |
| 4,271,222 | A * | 6/1981 | Hahn | 428/193 |
| 4,675,229 | A | 6/1987 | Westhead | |
| 4,740,409 | A | 4/1988 | Lefkowitz | |
| 4,931,010 | A * | 6/1990 | Barnewall | 442/323 |
| 6,057,255 | A | 5/2000 | Gass | |
| 2008/0251228 | A1 | 10/2008 | Matuschczyk | |

FOREIGN PATENT DOCUMENTS

| | | |
|---|---|---|
| EP | 0 355 277 A2 | 2/1990 |
| EP | 0 367 739 A2 | 5/1990 |

* cited by examiner

*Primary Examiner*—Arti Singh-Pandey
(74) *Attorney, Agent, or Firm*—Taylor IP, P.C.

(57) ABSTRACT

A belt for a machine for the production of web material, especially paper or cardboard, including a carrier structure and at least one layer of foam material characterized in that the carrier structure is surrounded by the foam material.

10 Claims, 1 Drawing Sheet

PAPER MACHINE BELT

BACKGROUND OF THE INVENTION

1. Field of the Invention

The present invention relates to a belt for a machine for the production of web material, especially paper or cardboard.

2. Description of the Related Art

A so-called press felt for a paper machine is known from EP 0 355 277 B1, which includes one layer of elastic foam material, which is joined through needle bonding with a carrier structure consisting of fibrous material. The foam, which consists of a polymer material, is of a closed-cell construction. A woven material is used, for example, for the carrier layer with yarns progressing in a longitudinal and a cross machine direction. A structure is created with a belt, or a press felt, which is constructed in this way which counteracts the hydraulic, or, respectively, capillary forces which attempt to draw water back to the surface of a paper layer being manufactured. A back-moistening effect in the belt material to be manufactured can be minimized in this manner.

EP 0 367 739 B1 discloses a method for coating a belt for a paper machine whereby a thin layer of polymeric foam material is applied to the upper surface of a press fabric. Here, the foam material remains primarily on the surface of the material, or, respectively, can partially penetrate the surface of the material.

What is needed in the art is a belt for the production of a fibrous web material, as well as a method for the production of such a belt, which effectively and efficiently meets the demands occurring in a press section.

SUMMARY OF THE INVENTION

The present invention provides a belt for a machine for the production of web material, especially paper or cardboard, including a carrier structure and at least one layer of foam material. The present invention further provides that the carrier structure is enclosed in the foam material.

In the belt of the present invention, the carrier structure is completely enclosed by or, in other words, embedded in the foam material. This provides a simple production method, since the foam material and the carrier structure do not need to be joined in separate production steps. With the belt of the present invention, the demands occurring in interaction with the web material that is to be produced can be favorably optimized, especially through the selection of the foam material, while the mechanical loads occurring in the longitudinal and cross machine direction can be allowed for through the selection of the carrier structure.

The utilized foam material is, for example, open-cell. Thermoplastic polymer material, for example, polyurethane material can be provided as the foam material. The foam material can, alternatively or additionally, include duroplastic polymer material, for example, melamine-formaldehyde.

The carrier structure may, for example, be formed by:

fibrous materials
woven materials
laid material structures
or
warp knit fabrics.

In addition, the present invention may provide that, in order to adapt the surface characteristics of the belt of the present invention to demands occurring in a production process, the foam material is bonded at least on one side with the nonwoven or fibrous material. The foam material with the carrier structure enclosed inside the foam can be produced in one film extrusion process. According to an additional aspect of the present invention, a generically constructed belt may provide that the foam material is open-cell and is supported on a carrier structure which is bonded with it.

Even through the separate production of the foam material and the carrier structure and the subsequent combining of these two layers, the entire production process is simplified compared to the use of a layer of nonwoven material, thanks to the utilization of the foam material.

According to an additional aspect, the present invention relates to a method for the production of a belt for a machine for the production of web material, especially paper or cardboard, whereby a carrier structure is enclosed by at least one layer of foam material in an extrusion process.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawing, wherein.

Figure 1:
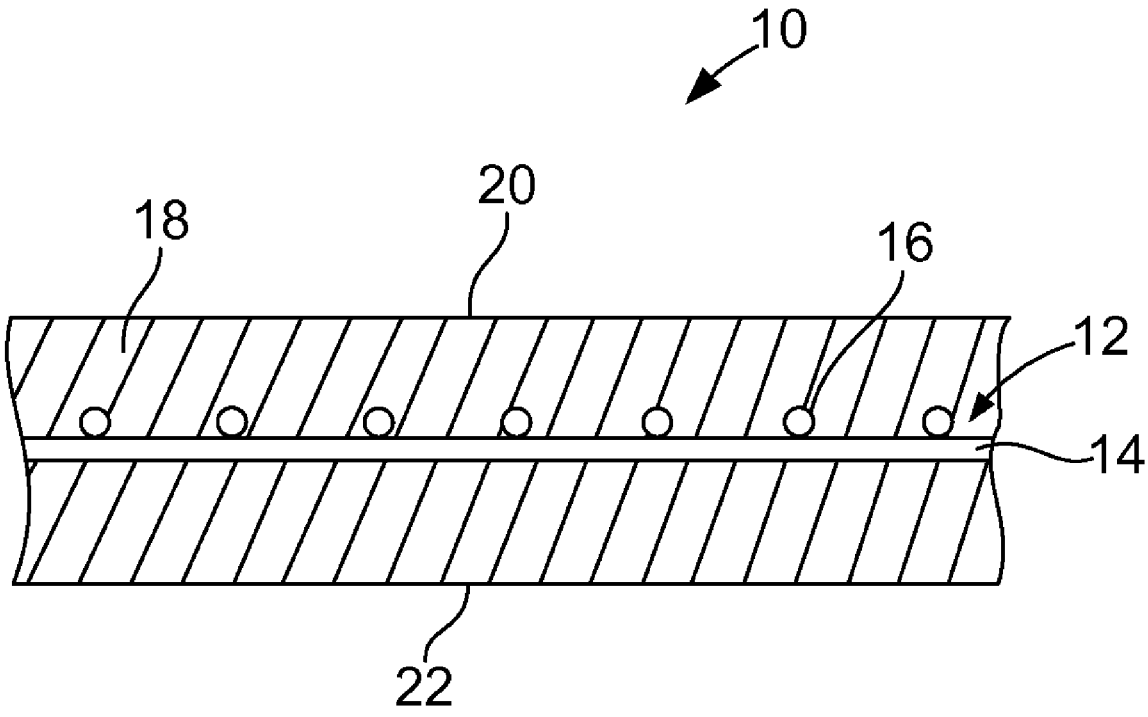
FIG. 1 illustrates a cross section of a belt according to the present invention.

The exemplification set out herein illustrates one embodiment of the invention and such exemplification is not to be construed as limiting the scope of the invention in any manner.

DETAILED DESCRIPTION OF THE INVENTION

Referring now to the drawing, and more particularly to FIG. 1, there is shown belt 10. Belt 10, illustrated in FIG. 1 can be utilized, for example, in a press section of a machine for the production of paper or cardboard and includes carrier structure 12. In the illustrated example, it is in the embodiment of a woven or laid fabric structure with longitudinal threads 14 progressing in a longitudinal direction of the belt, and cross threads 16 progressing in transverse direction of the belt. The longitudinal direction of the belt can be consistent with the machine direction and the transverse direction of the belt can be consistent with the cross machine direction.

Carrier structure 12 is routed through an extrusion head in a film extrusion process, and thereby surrounded with open-cell foam material 18. In this manner, the carrier structure is completely embedded by foam material 18 structure, thereby providing great stability. Through this bonding, and especially when utilizing a laid fabric structure, the individual threads of the laid structure are held in place relative to each other. The surfaces created on foam material 18 may, for example, form belt material contact surface 20 as well as machine contact surface 22.

Foam material 18 may, for example, include thermoplastic polymer material, for example, polyurethane material and, based on its open-cell structure, possess an outstanding water-removal characteristic. By adjusting the size of the cells contained in foam material 18 and selecting the foam material and its dimensions, it becomes possible to favorably accommodate the demands occurring in the area of the press section with regard to dewatering characteristics, abrasion characteristics and, respectively, also with regard to pressure elastic characteristics. The mechanical stability in longitudinal and cross direction is ensured by carrier structure 12. As previously mentioned, the carrier structure may, for example, be in the embodiment of a laid fabric structure. Of course, different carrier structure materials may be utilized, for example, woven materials, felt or nonwoven materials or mesh-type materials. Utilization of fibrous material, in other words a more or less loosely distributed long-fiber material, is also feasible as a carrier structure whereby the individual fibers are then held together primarily through foam material 18 surrounding them, creating a composite structure which can absorb the forces occurring in longitudinal direction and also in cross direction.

In addition, it is possible to provide several layers of foam material on one or on both sides with regard to carrier structure 12, whereby these layers may differ from each other with regard to their structural or material properties. Alternatively, or in addition, it is also possible to provide a layer of nonwoven or felt material on at least one side in order to bond, for example, through needle bonding with the foam material layer beneath it. This too can result in an adaptation of the characteristics of belt 10 to the demands occurring in a paper machine.

An alternative design variation may provide that foam material 18 does not embed carrier structure 12, but is produced separately and is placed on carrier structure 12 and subsequently bonded with it, for example, by material bonding, or through needle bonding or similar procedures. Also, a simpler production is ensured due to the replacement of the hitherto used nonwoven material or felt material with the foam material.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A belt for a machine for the production of a fibrous web, said belt comprising:

a carrier structure; and at least one layer of foam material surrounding said carrier structure, wherein said at least one layer of foam material is a melamine-formaldehyde.

2. A belt according to claim 1, wherein said at least one layer of foam material has an open-celled construction.

3. A belt according to claim 2, wherein said at least one layer of foam material is a thermoplastic polymer material.

4. A belt according to claim 3, wherein said at least one layer of foam material is a polyurethane material.

5. A belt according to claim 4, wherein said at least one layer of foam material is a duroplastic polymer material.

6. A belt according to claim 1, wherein said carrier structure is one of fibrous material, woven material, laid fabric structure and warp knit fabric.

7. A belt according to claim 6, wherein said at least one layer of foam material is bonded on at least one side with said carrier structure.

8. A belt according to claim 7, wherein said at least one layer of foam material is produced in one film extrusion process together with said carrier structure, said carrier structure being enclosed by said at least one layer of foam material.

9. A belt according to claim 1, wherein said at least one layer of foam material is open-cell and supported with said carrier structure, said at least one layer of foam material and said carrier structure being bonded.

10. A belt according to claim 1, wherein said belt is a press felt.

* * * * *